United States Patent [19]

Minar et al.

[11] 4,131,328

[45] Dec. 26, 1978

[54] ELECTRICAL CONNECTOR FOR SEQUENTIAL CONNECTION AND DISCONNECTION OF CIRCUITS

[75] Inventors: Frank M. Minar, Long Branch; Peter A. Abitante, Westfield, both of N.J.

[73] Assignee: The Perkin-Elmer Corporation, Norwalk, Conn.

[21] Appl. No.: 845,278

[22] Filed: Oct. 25, 1977

[51] Int. Cl.[2] ..... H01R 3/06

[52] U.S. Cl. ..... 339/14 R; 339/111; 339/217 S

[58] Field of Search ..... 339/14 R, 14 P, 111, 339/217 S

[56] References Cited

U.S. PATENT DOCUMENTS

| | | | |
|---|---|---|---|
| 2,742,624 | 4/1956 | Stevens | 339/14 R |
| 2,762,955 | 9/1956 | Herzog et al. | 339/14 R |
| 3,795,883 | 3/1974 | Ackerman et al. | 339/14 P |
| 3,927,925 | 12/1975 | Borsuk | 339/14 P |

FOREIGN PATENT DOCUMENTS

| | | | |
|---|---|---|---|
| 289213 | 12/1915 | Fed. Rep. of Germany | 339/14 R |
| 257017 | 8/1926 | United Kingdom | 339/14 R |

*Primary Examiner*—Gerald A. Dost

*Attorney, Agent, or Firm*—Salvatore A. Giarratana; Francis L. Masselle; John D. Crane

[57] ABSTRACT

A connector assembly including a plurality of male connector members each disposed for mating with a female connector member. Each female connector member is disposed on a support so that as the male and female connector members are urged together, electrical connection between all said pairs of male and female connector members does not occur simultaneously. Likewise as the connector members are urged apart, electrical connection is broken for some pairs of male and female connector members before others.

17 Claims, 7 Drawing Figures

ELECTRICAL CONNECTOR FOR SEQUENTIAL CONNECTION AND DISCONNECTION OF CIRCUITS

BACKGROUND OF THE INVENTION

The present invention relates to the field of electrical connectors and particularly to connectors for providing sequential connection and disconnection of circuits coupled thereto as the connector members are urged together or apart.

In contemporary electronic instruments, computers and the like, large numbers of solid state electronic devices are used, frequently in the form of integrated circuits. Each such integrated circuit device requires external electrical connection to a power source and usually requires further connections to couple signals to and from other circuit elements. Integrated circuits are usually mounted on printed circuit boards which have wiring thereon to inter-couple the integrated circuits on the same circuit board as well as to provide electrical connection from the integrated circuits to a connector assembly mounted thereon. This connector is sometimes known as a header and is utilized to couple the integrated circuits on the board with circuits on other boards as well as couple electrical power from an external bus to the circuits on the board.

Connectors utilized for this purpose usually have a plurality of female connectors, each identical to the other, which comprise the header. The header is designed to mate with a plurality of pins extending from a back panel. Each pin and female connector are usually quite small so that a large number of such female connectors are found in each header which occupies a small space.

While the above described connector arrangement has been used for some time, there are several disadvantages. The headers used, for example, comprise multipin connectors which must be carefully aligned with the pins on the back panel. Most headers which are economically feasable for use in computers, however, do not have alignment pins or the like therby making the headers difficult to plug into the mating connector on the back panel without possibly causing damage to the header or bending one or more pins on the back panel. In addition, headers are designed to be small in size to provide connection between many circuits in a very small space. Hence, the current carrying capacity of each such connection is low and several such connections must be coupled in parallel to connect power from the back panel to each printed circuit board.

The use of existing headers may also give rise to circuit failures when printed circuit boards are plugged and unplugged while power is on. Such possible failures are a risk associated with integrated circuits which are often sensitive to the sequence that power is turned on or off. While it is true that headers are designed to provide electrical connection to all circuits simultaneously as one is plugged into a back panel, in truth, such does not occur. Electrical power may be coupled to the circuits on the board before the ground is connected which may cause a circuit failure. Accordingly, existing headers may complicate maintenance of instruments or computers in which they are used as power must be turned off before a circuit board is replaced.

In view of the above described problems with existing headers, it is the principal objective of the present invention to provide a power connector for use with integrated circuits disposed on printed circuit boards which will prevent circuit failures from occurring due to improper power connection sequence.

It is a further objective of the invention to provide a connector having the above described attribute as well as having sufficient current carrying capacity so that excessive number of contact pins need not be used for providing needed power to a printed circuit board.

It is still another objective of the invention to provide a sequential power connector which can also be utilized to align a header mounted on the same printed circuit board as the board is plugged into the back panel.

BRIEF DESCRIPTION OF THE INVENTION

The invention includes a female connector having a support body with a bore into which a female barrel connector member is inserted. The support body has a plurality of apertures passing through the bore which receives the barrel connector. One of these apertures is cooperative with a retainer on the barrel connector to position it within the support body, the position being previously selected to provide the desired power connection sequence.

A plurality of such female connectors are mountable on a printed circuit board or the like and are cooperative with male connector members mounted on a back panel to align the printed circuit board with the back panel. The male connector members cooperate with the female connectors so that as they are plugged together, sequential electrical contact with the female barrel connector members occur as a function of the aperture in which each retainer is located.

BRIEF DESCRIPTION OF THE DRAWINGS

The foregoing and other objectives, advantages and features of the present invention are described below in greater detail in connection with the drawings wherein.

DETAILED DESCRIPTION

Figure 1:
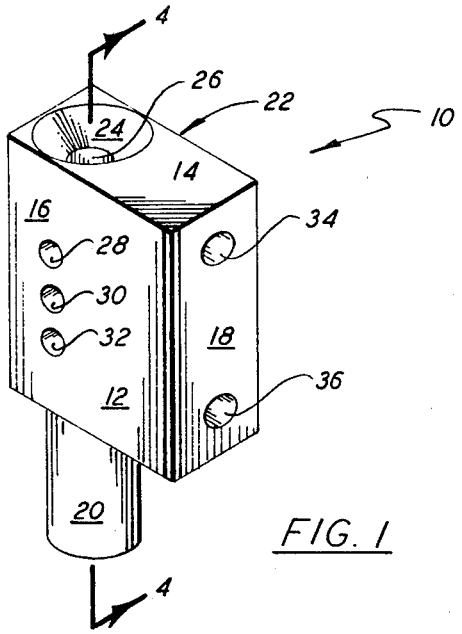
FIG. 1 is a perspective drawing of the support body for a female connector member according to the invention.
Figure 2:
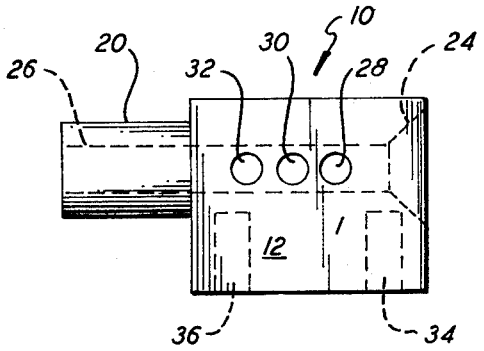
FIG. 2 is a side elevational view of the support body in FIG. 1.

Referring first to FIGS. 1 and 2, a female connector according to the present invention is indicated generally at 10. The female connector 10 has a support body 12 made of a non-conducting material such as nylon or other insulating material and may be manufactured by any suitable process such as molding, machining or the like in a shape generally as shown. The support body 12 has an upper portion generally in the shape of a rectangular solid having a top surface 14 and two side surfaces 16 and 18. Projecting downwardly from the bottom surface (not shown) which is disposed generally in parallel relation with the top surface 14 is a cylindrical portion 20.

The top surface 14 has an opening therein indicated generally at 22 which has a chamfered region 24 which forms an inwardly and downwardly tapering surface which tapers inwardly until it communicates with a bore 26 which passes completely the support body 12 and exits through the bottom of the cylindrical portion 20. As is described later, this bore 26 serves to receive the female connector member in accordance with the present invention.

The support body 12 also has three other bores 28, 30 and 32 which are preferably cylindrical and positioned to pass through the bore 26 from the side surface 16 to the opposite side of the body 12 (not seen). As will be described below in greater detail, the bores 28, 30 and 32 are utilized in accordance with the present invention to secure the female connector member in the bore 26. Those of skill in the art will also recognize that the bores 28, 30 and 32 need not be cylindrical but could have any suitable cross section. The bores 28, 30 and 32 can be formed by any suitable fabrication method. They can also be replaced by pockets formed in the wall of the bore 26.

Two additional bores 34 and 36 enter the support body 12 through the side surface 18. These bores 34 and 36 are preferably disposed so their axes will pass through the axis of the bore 26 although the bores 34 and 36 are not deep enough to communicate with the bore 26. The bores 34 and 36 are utilized in accordance with the present invention to receive self-tapping screws or the like thereby permitting the female connector 10 to be affixed to a printed circuit card or the like by such self-tapping screws. The self-tapping screws should be selected so that, when screwed into the bores 34 and 36, they will secure the female connector 10 to the desired surface without extending into the body 12 far enough so as to come into electrical contact with any connector member disposed in the bore 26. Alternatively, the connector 10 can be attached to a printed circuit board or the like by glue or other suitable attachment means.

Figure 3:
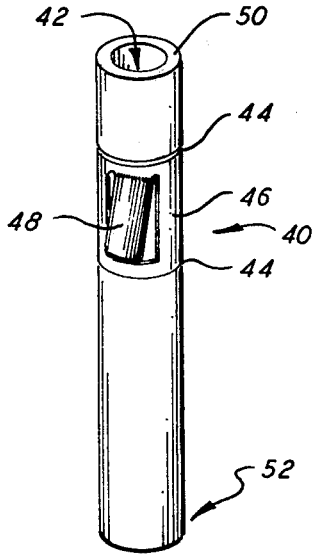
FIG. 3 is a female barrel connector member.
Figure 4:
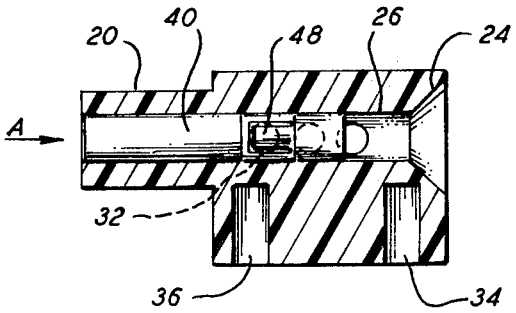
FIG. 4 is a side sectional view of the support body of FIG. 1 taken along section line 4—4 as viewed in FIG. 1.
Figure 5:
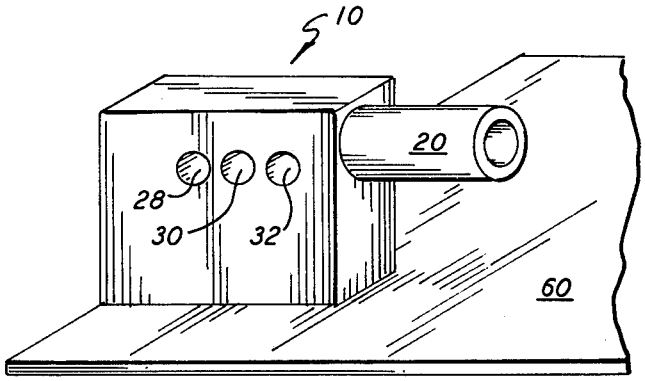
FIG. 5 shows schematically the female connector according to the invention mounted on a printed circuit board.

Referring now to FIG. 3, a female connector member is indicated generally at 40. The female connector member 40 is made of any suitable electrically conductive material and is fabricated with a male connector receiving bore 42 which is coaxially disposed with respect to the longitudinal axis of the generally cylindrically shaped connector member 40. The connector member 40 is either machined or formed to have a recessed portion 44 on its exterior surface disposed near the entrance to the bore 42 to provide a location for a retainer 46 which rides in the recessed portion 44. The retainer has a detent tab portion made of a flexible metal which projects outwardly from the female connector member 40. The female connector 40 is of the proper size and shape to be just smaller than the bore 26 so that the connector member 40 can be inserted into the bore 26. As viewed in FIG. 4, the connector member 40 is inserted into the bore 26 in a direction indicated by the arrow A with the end thereof having the male connector receiving bore 42 therein entering the bore 26 first. As the female connector member 40 slides in the bore toward the chamfered region 24, the detent tab 48 presses against the sides of the bore 26 through female connector member 40. When properly located, the detent tab 48 springs away from the sides of the bore 26 into one of the bores 28, 30 or 32. In FIG. 4, the detent tab 48 is shown at a position where it can spring outwardly from the connector member 40 into the rear most located bore indicated by the dotted line 32. By further forcing the female connector member 40 in the direction indicated by the arrow A, the detent tab 48 will successively spring outwardly from the female connector member 40 into bores 30 and 28.

As viewed best in FIG. 3, the detent tab 48 is made of a flexible metal or the like and shaped so as to be adjacent the sides of the female connector member 40 at points closest to the male connector receiving bore 42 and furthest from the sides of the connector body 40 at the point most remote from the male connector receiving bore 42. By reason of this construction, as the female connector member is inserted into the bore 26 in the support body 12 in direction A, the tab 48 is forced against the side of the female member 40. When the detent tab 48 engages one of the bores 28, 30 or 32, the female connector member 40 locked in place and cannot be forced through the bore 26 in a direction opposite arrow A. The female connector member 40, however, can be further forced through the cylindrical bore 26 in the direction indicated by the arrow A.

The female connector 40 is of a size and shape to slide into the bore 26. When the female connector member 40 is disposed in the bore 26 with detent tab 48 in the bore 38, the forward facing surface 50 of the female connector member 40 does not project through the junction between the chamfered region 24 and the bore 26. Naturally, when the female connector member is positioned with its detent tab 48 in either cylindrical bore 30 or 32, the forward facing surface 50 will not project through the junction between the bore 26 and the chamfered region 24.

The female connector member 40 is electrically coupled to external circuitry by any suitable means by way of an electrical connection located generally at the end 52. One means for such suitable electrical connection comprises having a bore in the female connector member 40 at the end opposite the end having the male connector receiving bore 42. An electrically conductive wire or the like can then be soldered into this bore and connected to the desired external circuit. The wire connecting the female member 40 (not shown) not only serves to connect it to circuits on the circuit board on which the connector is mounted but also serves to prevent further movement of the female member 40 in the direction A as viewed in FIG. 4. This function is accomplished by bending the wire as it exits the cylindrical portion 20 in a direction generally perpendicular to the axis of the bore 26. When the detent tab 48 projects into one retaining bore 28, 30, or 32 and the wire (not shown) connecting to the member 40 is bent perpendicular to the axis of bore 26, the female member 40 is locked in position in the bore 26 preventing movement thereof in direction A or the opposite direction. Other suitable electrical connections to the female connector member 40 when it is disposed in the support body 12 will occur to those of skill in the art and such electrical-connections can be made without departing from the spirit and scope of the present invention. One such alternative (not shown) involves making the female member 40 and the connecting wire of one piece. The wire merely is a turned down tail like member which is bendable and projects from the end of member 40 indicated at 52 in FIG. 3.

Referring now toFIG. 5, the female connector 10 is shown mounted to a printed circuit board 60. As indicated earlier, the connector 10 is secured to a printed circuit board 60 by self-tapping screws or the like which pass through the printed circuit board 60 and into the bores 34 and 36. Alternatively, the female connector 10 might be secure to the printed circuit board 60 by means of any other suitable attachment mechanism or by glue.

Figure 6:
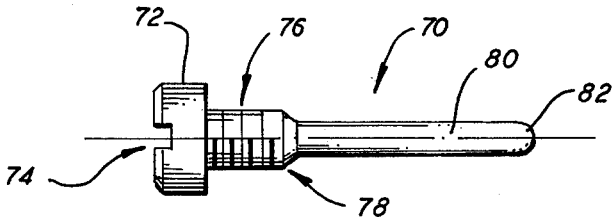
FIG. 6 shows a male connector member suitable for use with the female connector of FIG. 1.

Referring now to FIG. 6, a male connector member in accordance with the present invention is indicated generally at 70. This male connector member 70 has a notched head portion 72 having a notch at 74 for receiving the tip of a screwdriver or the like. Immediately adjacent the notched head portion 72 is a threaded portion 76 which permits the connector member 70 to be screwed into another body such as a power bus. The threaded portion 76 includes a tapered portion 78 which assists in properly seating the threaded portion in a correspondingly threaded hole in the body into which the connector member 70 is screwed. Extending from the smallest diameter end of the tapered portion 78 is a turned down portion 80 which is substantially cylindrically shaped with a rounded tip 82. The longitudinal axis of the turned down portion 80 is preferably coaxially aligned with the axis of the threaded portion 76 and the notched head portion 72. The diameter of the turned down portion 80 is selected so that it will slide easily into the male connector receiving bore 42 of the female connector member 40 shown in FIG. 3 and also make low resistance electrical contact therewith.

The foregoing description describes the preferred form of the male connector member 70, however, those of skill in the art will readily recognize that the male connector member may be constructed in numerous other shapes which will have little or no effect on the operation of the invention. The only requirement of the male connector member 70 so far as the sequential connect/disconnect aspect of the invention is that means must be provided whereby each such male connector member is disposed on a body such that the turned down portion 80 will project from the body on which it is mounted the same distance as any other such male connector member. In addition, each male connector member 70 must project a sufficient distance from the body on which it is mounted so that the turned down portion 80 makes low electrical resistance contact with the male connector receiving bore 42 disposed in a support body 12 which is mounted on another body regardless of the bore 28, 30 or 32 in which the detent tab 48 is disposed.

Figure 7:
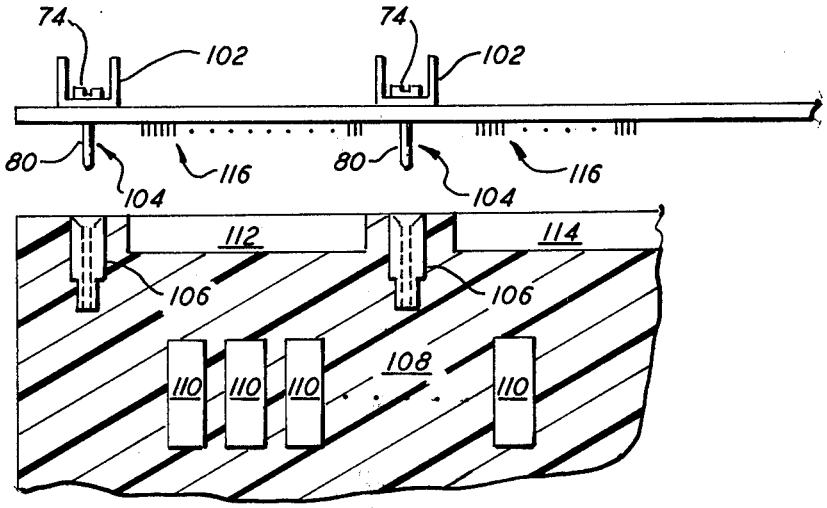
FIG. 7 shows an end view of a back panel with one connector of FIG. 6 shown for coupling a power bus on the back panel to a printed circuit board.

Referring now to FIG. 7, the connector arrangement in accordance with the present invention is shown in a typical operational environment. In this environment, a substantially planar back panel 100 is disposed in a plane generally perpendicular to the sheet on which FIG. 7 is drawn. Disposed on one side of the back panel 100 are a plurality of elongated power bus members 102 (two being shown) having a substantially U-shaped cross section. The bus members 102 are made of a electrically conducrive material suitable for carrying a substantial current such as copper and serve to make power available on the back panel 100. Each of the power bus members 102 is connected either to ground potential or to a power supply providing a potential other than ground.

As shown in FIG. 7, male connector members 104 in accordance with the present invention screws into a power bus member 102 in a manner such that the notched head portion 74 is located at the base of each U-shaped bus member 102 and the turned down portion 80 projects through the back panel 100 a sufficient distance such that it can provide electrical contact with the female connector member disposed in the female connector assembly indicated generally at 106 when the two are urged toward each other. The female connector 106 is mounted on a printed circuit card which is substantially planar and disposed, as viewed in FIG. 7, substantially in the plane of the paper.

Disposed on the printed circuit card are a plurality of integrated circuits 110 which are interconnected to each other by printed circuit wiring (not shown) which is formed on the printed circuit card 108. These circuits 110 are also coupled by wiring (not shown) to the female connectors 106 so that the required electrical power is made available to the circuits 110 when the card 108 is plugged to the back panel 100.

Disposed along the edge of the printed circuit card 108 closest the back panel 110 are headers 112 and 114 (more headers may be used if desired). These headers 112 and 114 generally comprise connectors for coupling a large number of wires on the printed circuit board 108 with similar wires on the back panel 100. The wires on the back panel 100 couple via connector pins 116 which project outwardly from the back panel 100 and lie generally in the plane of the paper on which FIG. 7 is drawn. These pins 116 will mate with corresponding sockets in the header 112 when the printed circuit card 108 is urged toward the back panel 100 until the pins 116 are received in the header 112. It should be noted that the female connector assemblies 106 serve to align the printed circuit card 108 with the back panel 100 as one is urged toward the other. This alignment is facilitated by the chamfered portion 24 of each female connector 106 which serves to guide the pins 104 into the connectors 106 as the circuit board 108 is urged toward the back panel. Alignment of the headers 112, 114 with the pins 116 is facilitated by the fact that the pins 104 are longer than pins 116 so they mate with connectors 106 thereby aligning pins 116 with the header 112, 114.

The sequential power connection feature in accordance with the present invention is accomplished in the configuration of FIG. 7 by locating the female connector member in each female connector assembly 106 at the desired position. For example, the female connector member in the right most female connector assembly 106 in FIG. 7 may be disposed so that it is located closest to the chamfered portion while the female connector member in the left most female connector assembly 106 of FIG. 7 may be disposed at the rear most position, i.e., such that the turned down portion must be inserted into the female connector assembly to its fullest extent before electrical connection is made. Accordingly, as the printed circuit board 108 is urged toward the back panel 100, the right most pin 104 will make electrical contact with the right most connector 106 prior to electrical connection being established between the left most pin 104 and connector 106. If the right most pin 104 is at ground and the left most pin 104 is at +5 volts, a ground connection is established to the board 108 before voltage is applied as the board 108 is plugged into the back panel 100. On unplugging, power is removed and then the ground is removed.

While the foregoing description of the present invention has made particular emphasis on the preferred embodiment therefor as shown in the drawings, those skilled in the art will readily recognize that numerous modifications other than those already described may be made to the preferred form of the invention without departing from the spirit and scope of the invention. For example, a particular means is shown for positioning the female connector member inside the support body which permits sequential application of power to circuits connected to several such connectors in a manner which prevents circuit destruction. The particular means for securing the female connector member as such, however, is not overly critical as other equally effective positioners can be devised. The approach shown above, however, does offer the advantage of being rather inexpensive to manufacture.

Those of skill in the art will also readily recognize that the particular shape of the support body as shown in the drawings is not itself critical and, therefore, it could take other forms, for example, that of a rectangular solid with appropriate bores.

Those of skill in the art will also recognize that each female connector member can be constructed so that sequential connection is provided amongst a plurality of connectors with two or more positions being available for each female connector member within the support body. This modification is achieved, for example, by providing at least two different bores in the support body each with at least two positions at which the retaining mechanism is operative to secure each female connector member within the support body.

A further alternative to the invention involves rigidly locating female members on one board and locating male connector members of different length on another board. As the connector members are urged together, sequential connection occurs. The only requirement is that each male connector member be at least long enough to establish electrical contact with a female member when the two boards are fully urged together.

The foregoing and other modifications to the present invention may be made without departing from the spirit or the scope of the invention as defined in the following claims.

What is claimed is:

1. A connector assembly for providing sequential connection and disconnection of electrical circuits coupled thereto comprising, in combination:

a support body with a plurality of substantially identical male connector members each extending from said support body a uniform distance;

a connector body with plurality of substantially identical apertures therein, each aperture being positioned and of a size sufficiently large to receive each said male connector member on said support body when said support body and said connector body are urged toward each other, said connector body has a plurality of detent openings disposed along each said aperture;

each said aperture in said connector body having a female connector barrel disposed therein, each said barrel being disposed in an aperture so that it is capable of electrically contacting the male connector member received in the aperture housing said barrel, when said support body is urged toward the said second connector body; and means to selectively locate each said barrel member at a desired position within the aperture housing each said barrel member.

2. The connector assembly of claim 1 wherein each said connector barrel has a detent tab for engaging one said detent opening in said connector body.

3. The connector assembly of claim 1 wherein said aperture has a chamfered portion to assist in aligning said connector body and said support body as said connector body and said support body are urged toward each other.

4. An electrical assembly permitting sequential connection and disconnection of circuits coupled thereto comprising, in combination:

a plurality of male connector members mounted rigidly with respect to each other on a first body;

a connector body with a plurality of apertures therein, each said aperture being located and of a size to receive one said male connector as said first body and said connector are urged toward each other, each said aperture has a plurality of detent openings;

a female connector barrel disposed in each said aperture of said connector, and providing electrical contact with each said male connector member when said first body and said connector body are pressed together, each said barrel has at least one detent means engagable with a selected one of said detent openings, said barrels being selectively positioned so that partial withdrawal of said male connector members from said aperture causes at least one said male connector member to loose contact with one said barrel while the remaining male connector members remain in electrical contact with a barrel.

5. The electrical connector assembly of claim 4 wherein each said aperture has a chamfered portion for assisting in alignment of said male connector members with said apertures as said first body is urged toward said connector body.

6. The electrical connector assembly of claim 4 wherein said connector body and said female connector barrel each including means cooperative with each other to dispose said barrel in each aperture at a selected one of a plurality of positions.

7. An electrical connector selectively permitting establishing electrical connection with a male connector member as a function of the depth of penetration comprising, in combination:

a body with an elongated bore therein, said body being made of an insulating material;

a female connector barrel made of an electrically conductive material and shaped to be moveable in said bore, said barrel including an aperture for receiving and making electrical contact with a male connector member which may be inserted therein;

means to selectively locate said female connector barrel at one of a plurality of positions within said bore; and said locating means includes a plurality of pockets in said bore and a detent means on said barrel, said detent means being operative to selectively engage one said pocket to hold said barrel in one selected position relative to said bore.

8. The electrical connector of claim 7 wherein said detent means comprises a yieldable material projecting outwardly from said barrel, said detent means being engagable with any said pocket as said barrel is moved through said bore in one direction, engagement of said detent with one said pocket preventing movement in a direction opposite said one direction.

9. The electrical connector of claim 7 wherein said barrel includes a portion which is suitable for electrical connection to an external circuit.

10. The electrical connector of claim 7 additionally including a chamfered portion communicating from an exterior surface of said body to said bore.

11. The electrical connector of claim 7 wherein said pockets comprise holes passing through said body and said bore in a direction substantially perpendicular to said bore.

12. An electrical connector assembly permitting sequential connection and disconnection of circuits coupled thereto comprising, in combination:

a plurality of elongated male connector members each coupled adjacent to one end thereof to a support member, each said male connector member being located parallel to each other and in a plane which can be drawn through each said male connector member;

a plurality of female connector members each adapted to receive one said male connector member;

means to support said plurality of female connector members in the spatial relation required to permit mating with said plurality of male connector members, said female support means including positioning means for each said female connector member permitting each female connector member to be located at one of a plurality of positions so that on forcing said male and said female connector members together, connection is made between some of said male and female connector members before connection is made between other said male and female connector members;

said support means includes a bore to receive each said female connector member, each said bore including a plurality of support portions; and each said female connector member having a detent means engagable with any said support portion to secure each said female connector member in a bore in a desired support portion.

13. The connector assembly of claim 12 wherein each said bore is elongated and generally cylindrically shaped.

14. The connector assembly of cliam 12 wherein each said support portion comprises a detent receiving opening in the wall of one said bore.

15. The connector assembly of claim 13 wherein each said support portion comprises a detent receiving bore in said support member communicating with one said bore.

16. The connector assembly of claim 14 wherein said detent comprises a flexible tab member extending laterally of each said female connector member for interfitting with one said detent receiving bore.

17. The connector assembly of claim 16 wherein each said tab member is shaped so said female connector member can be inserted into said bore in a first direction but cannot be removed in the opposite direction.

* * * * *